United States Patent [19]

Maeda

[11] Patent Number: 4,730,588

[45] Date of Patent: Mar. 15, 1988

[54] VALVE OPERATING SYSTEM FOR AN AUTOMOTIVE ENGINE

[75] Inventor: Satoshi Maeda, Mitaka, Japan

[73] Assignee: Fuji Jukogyo Kabushiki Kaisha, Tokyo, Japan

[21] Appl. No.: 40,403

[22] Filed: Apr. 20, 1987

[30] Foreign Application Priority Data

Apr. 25, 1986 [JP] Japan ..... 61-96527

[51] Int. Cl.[4] ..... F02B 43/00; F01L 1/34

[52] U.S. Cl. ..... 123/432; 123/90.16; 123/90.18; 123/90.6

[58] Field of Search ..... 123/432, 90.15, 90.6, 123/90.16, 90.17, 90.18

[56] References Cited

U.S. PATENT DOCUMENTS

| | | | |
|---|---|---|---|
| 3,839,858 | 10/1974 | Avermaete | 123/90.18 |
| 4,182,289 | 1/1980 | Nakajima et al. | 123/90.39 |
| 4,388,897 | 6/1983 | Rosa | 123/90.17 |
| 4,498,352 | 2/1985 | Hedelin | 123/90.17 |

FOREIGN PATENT DOCUMENTS

| | | | |
|---|---|---|---|
| 2950656 | 6/1981 | Fed. Rep. of Germany | 123/90.17 |
| 57-86512 | 5/1982 | Japan . | |
| 57-188715 | 11/1982 | Japan . | |
| 135609 | 7/1985 | Japan | 123/90.17 |

*Primary Examiner*—E. Rollins Cross

*Attorney, Agent, or Firm*—Martin A. Farber

[57] ABSTRACT

A system is provided for an automotive engine comprising two intake valves for one cylinder, and a camshaft having cams for operating the intake valves. One of the cams is rotatably and axially slidably mounted on the camshaft. An eccentric conical hole is in a side of the cam and an eccentric conical portion is formed on the camshaft. A hydraulic cylinder is formed between the cam and the camshaft to form an oil chamber so as to shift the cam, and a spring is provided for urging the cam to the oil chamber. When the cam is shifted by the operation of the cylinder, the eccentric conical hole of the cam is engaged with the conical portion at a predetermined angular position.

3 Claims, 4 Drawing Figures

VALVE OPERATING SYSTEM FOR AN AUTOMOTIVE ENGINE

BACKGROUND OF THE INVENTION

The present invention relates to a valve mechanism for an automotive engine.

In order to improve combustion in an entire range of engine speed, a multiple-valve type engine, each cylinder of which has two or more intake valves is known. In a low engine speed range, one of the intake valves of each cylinder is held in closed state. Various valve stopping means are proposed. Japanese patent Laid Open No. 57-86512 discloses a valve stopping device mounted in a rocker arm, and Japanese patent Laid Open No. 57-188715 discloses a rocker arm device comprising high speed rocker arm and low speed rocker arm. However, these devices are complicated in construction and large in size.

SUMMARY OF THE INVENTION

The object of the present invention is to provide a valve stopping device which is simplified in construction and small in size.

According to the present invention, there is provided a valve operating system for an automotive engine having two or more intake valves for one cylinder, a camshaft having cams for operating the intake valves. The system comprises one of the cams being rotatably and axially slidably mounted on the camshaft, clutch means for engaging the slidable cam with the camshaft at a predetermined angular position, shifting means for axially shifting the slidable cam to engage the cam with the camshaft by the clutch means.

In an aspect of the present invention, the clutch means includes an eccentric conical hole formed in the cam and an eccentric conical portion formed on the camshaft, and the shifting means comprises a hydraulic cylinder formed between the cam and the camshaft to form an oil chamber, and a spring for urging the cam to the oil chamber.

The other objects and features of this invention will be apparently understood from the following description with reference to the accompanying drawings.

DETAILED DESCRIPTION OF THE PREFERRED EMBODIMENT

Figure 1:
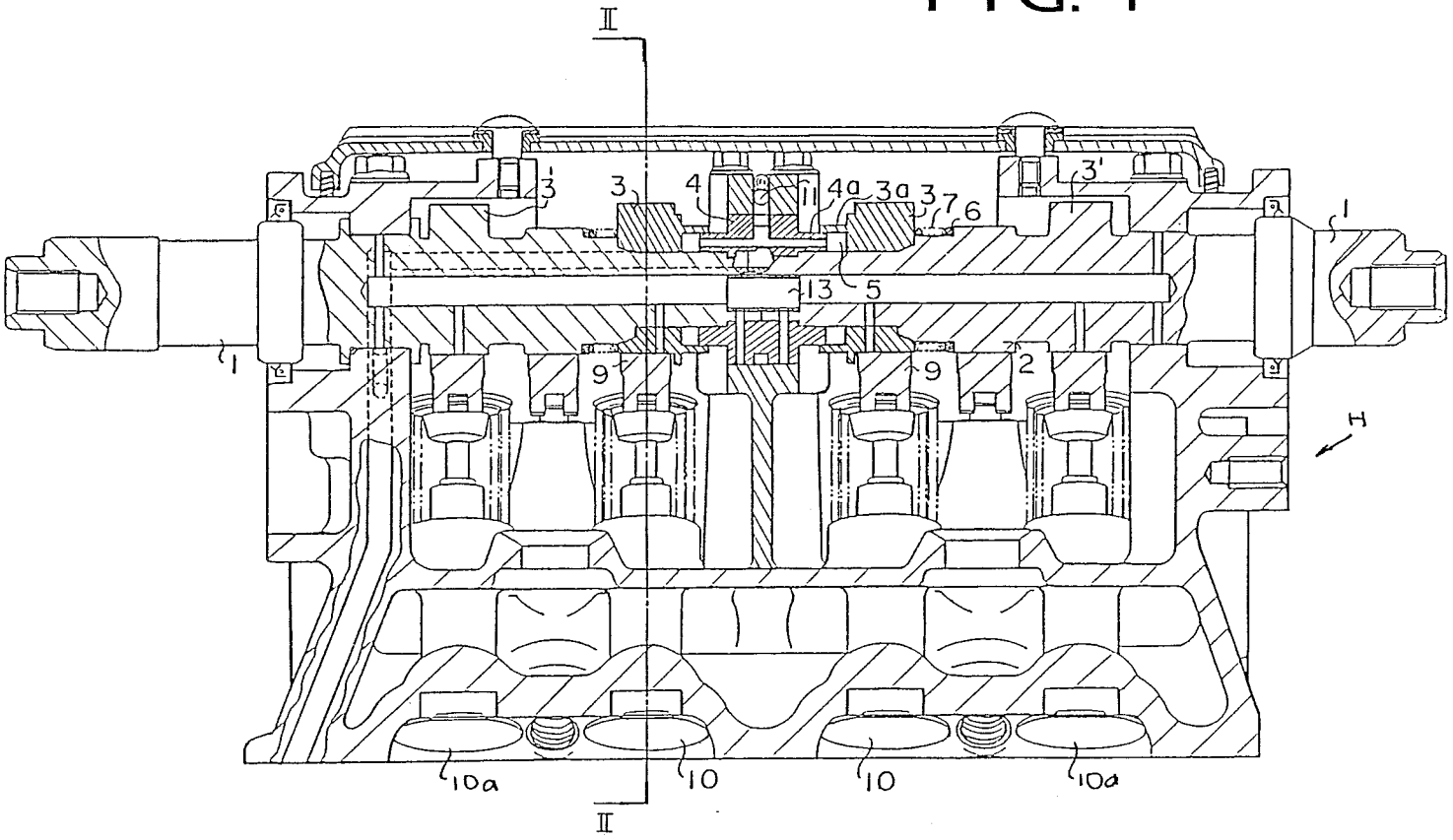
FIG. 1 is a sectional view of a cylinder head in which a device according to the present invention is mounted.
Figure 2:
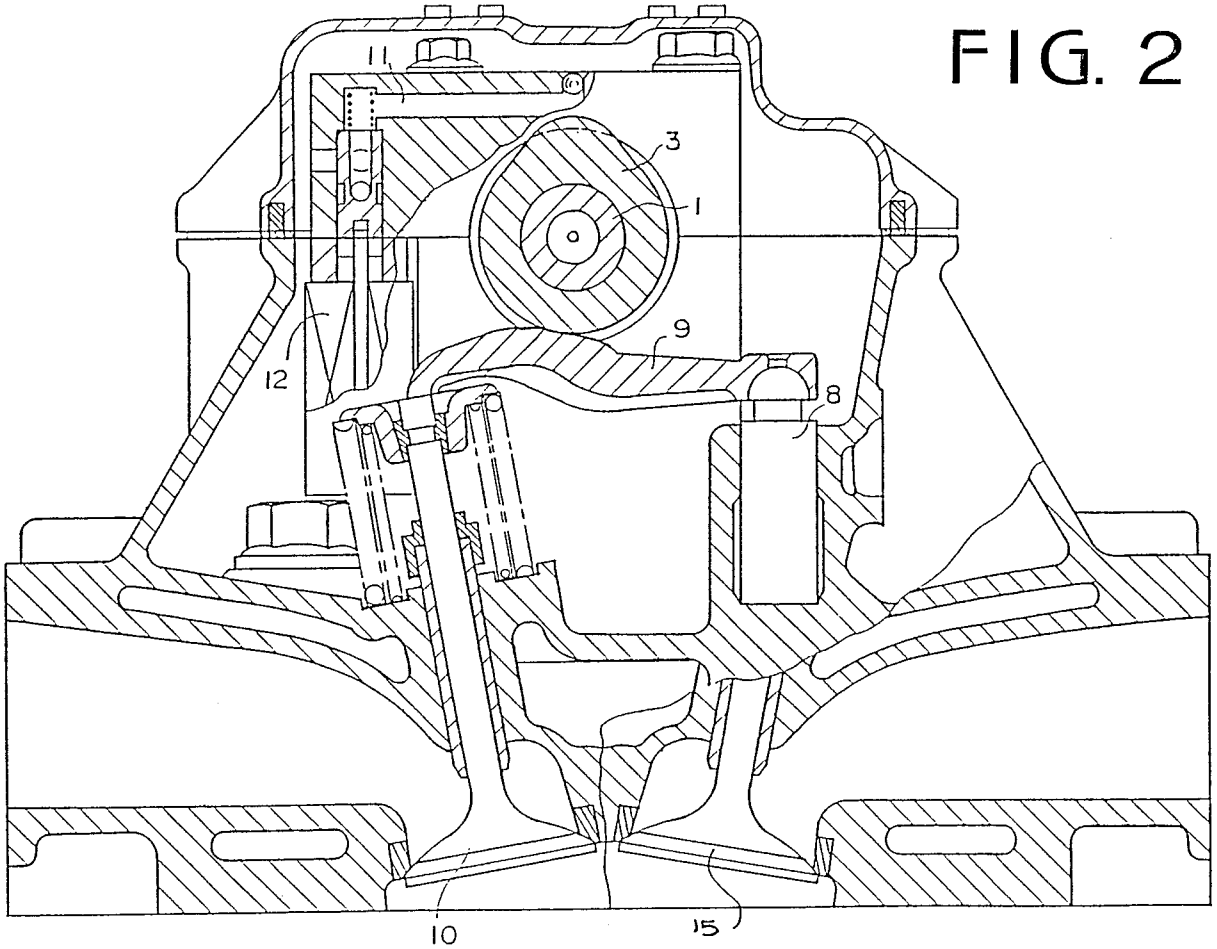
FIG. 2 is a sectional view taken along a line II—II of FIG. 1.

Referring to FIGS. 1 and 2, there is shown a cylinder head H for two cylinders, each having two intake valves 10 and 10*a* and one exhaust valve 15. A camshaft 1 comprises a pair of shafts which are relatively positioned by a pin 13 and connected by a journal member 4.

On the camshaft 1, cams 2 for the exhaust valves 15 and cams 3' for the intake valves 10*a* are integrally formed. Cams 3 for the intake valves 10 are rotatably and axially slidably mounted on the camshaft 1. Since both the cams 3 for adjacent cylinders are symmetrical and are the same in construction, only one cam and a device about the cam will be described hereinafter.

Figure 3:
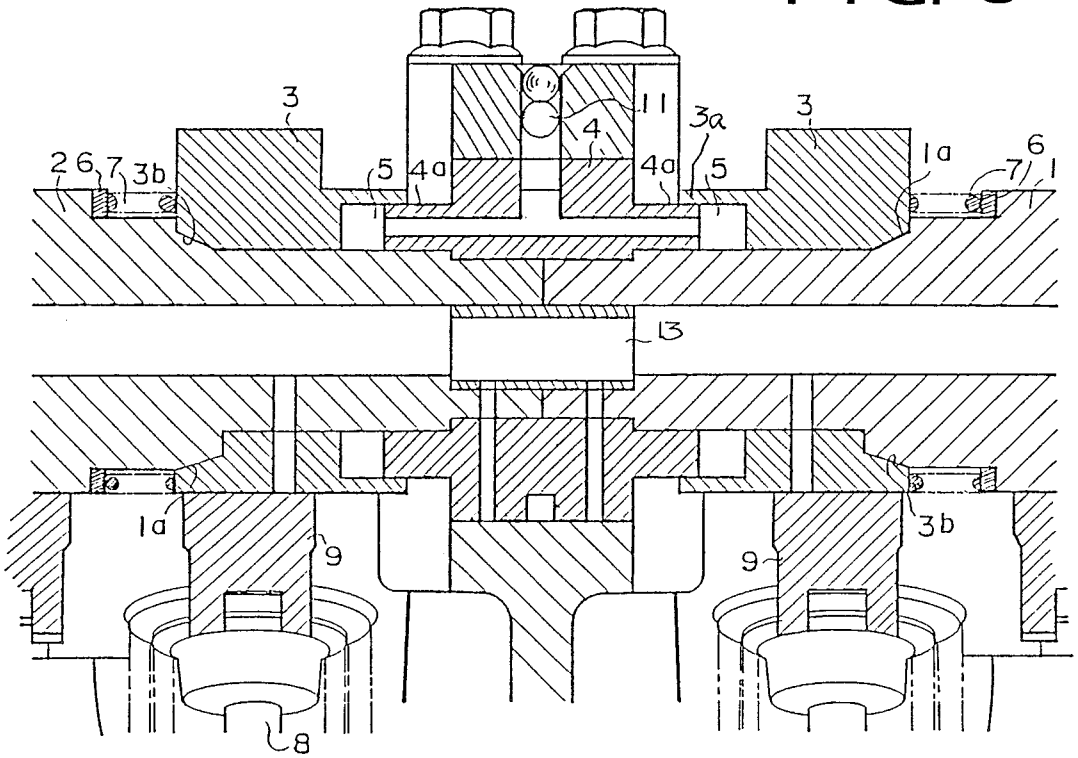
FIG. 3 is an enlarged view of a part of FIG. 1.
Figure 4:
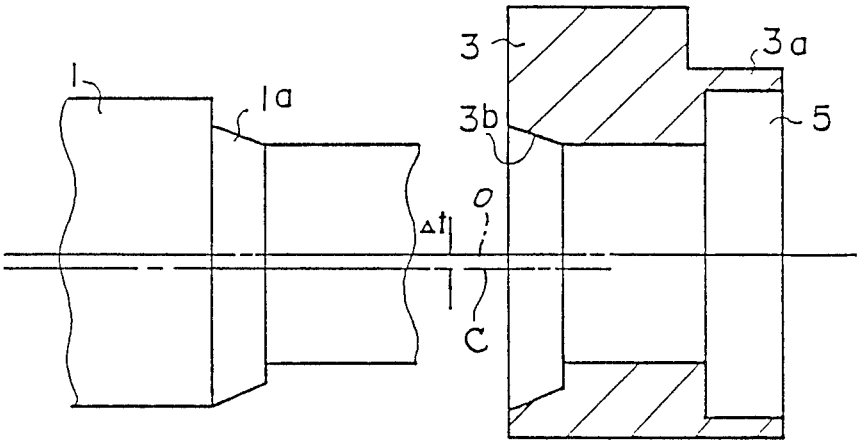
FIG. 4 is an enlarged view showing a cam and a camshaft.

Referring to FIG. 3, the cam 3 has a cylindrical portion 3*a* at one side adjacent the journal member 4. The cylindrical portion 3*a* is rotatably and slidably engaged mounted on a cylindrical projection 4*a* of the journal member 4 to form an oil chamber 5. The cam 3 further has an eccentric conical hole 3*b* at the other side thereof. The center C of eccentric conical hole 3*b* is deviated Δt from the center of the axis 0 of the cam 3 as shown in FIG. 4. The camshaft 1 has an eccentric conical portion 1*a* corresponding to the conical hole 3*b*.

A coil spring 7 is disposed between the side of the cam 3 and a retainer 6 mounted on the camshaft 1 to urge the cam toward the chamber 5. The chamber 5 is communicated with an oil pump (not shown) through a solenoid operated control valve 12 (FIG. 2). As shown in FIG. 2, the cam 3 engages with a rocker arm 9 engaging with a stem of intake valve 10 and with a hydraulic lash adjuster 8.

In a low engine speed range, oil in the chamber 5 is drained through the control valve 12, so that the cam 3 is shifted to the journal member 4. As a result, the cam 3 is disengaged from the conical portion 1*a* of the camshaft 1. Thus, the cam 3 is not rotated by the camshaft 1, so that the intake valve 10*a* is not opened. Accordingly, only intake valve 10 is operated by the cam 3'.

In a high engine speed range, oil is supplied to the chamber 5 by operating the control valve 12, so that the cam 3 is pushed to the conical portion 1*a*. However, the cam 3 can not be shifted to the conical portion 1*a* unless the phase of the cam 3 coincides with that of the camshaft 1. When both the phases coincide with each other (namely the center of conical hole 3*b* coincides with that of the conical portion 1*a*), the cam 3 is shifted to engage with the conical portion 1*a*. Thus, the cam 3 is rotated by the camshaft 1 to operate the the intake valve 10.

Although the above described system is provided with eccentric engaging clutch means comprising the conical hole 3*b* and conical portion 1*a*, another clutch means such as a dog clutch engaging at a pre-determined angular position can be employed.

While the presently referred embodiment of the present invention has been shown and described, it is to be understood that this disclosure is for the purpose of illustration and that various changes and modifications may be made without departing from the spirit and scope of the invention as set forth in the appended claim.

What is claimed is:

1. In a valve operating system for an automotive engine having two or more intake valves for one cylinder, a camshaft having cams for operating the intake valves, the system comprising:

one of the cams being rotatably and axially slidably mounted on the camshaft;

clutch means for engaging the slidable cam with the camshaft at a predetermined angular position;

shifting means for axially shifting the slidable cam to engage the cam with the camshaft by the clutch means.

2. The system according to claim 1 wherein the clutch means includes an eccentric conical hole formed in a side of the cam and a complementary eccentric conical portion formed on the camshaft.

3. The system according to claim 1 wherein the shifting means comprises a hydraulic cylinder formed between the cam and the camshaft to form an oil chamber, and a spring for urging the cam to the oil chamber.

* * * * *